United States Patent [19]

Damitio et al.

[11] Patent Number: 4,950,874

[45] Date of Patent: Aug. 21, 1990

[54] EXPANSION JOINT FOR KEYBOARD DOME SHEETS

[75] Inventors: Stephen S. Damitio, Spokane, Wash.; George P. English, Hayden Lake, Id.

[73] Assignee: Key Tronic Corporation, Spokane, Wash.

[21] Appl. No.: 410,912

[22] Filed: Sep. 22, 1989

[51] Int. Cl.[5] ..... G06C 7/02; H01H 9/00

[52] U.S. Cl. ..... 235/145 R; 200/5 A; 400/472

[58] Field of Search ..... 200/5 A, 512, 513–517, 200/302.2, 329, 345; 235/145 R; 340/711; 400/479, 472

[56] References Cited

U.S. PATENT DOCUMENTS

| | | | |
|---|---|---|---|
| 3,823,309 | 7/1974 | Caruso | 200/5 A X |
| 4,057,710 | 11/1977 | Willmott | 200/345 X |
| 4,066,850 | 1/1978 | Heys, Jr. | 200/5 A |
| 4,237,351 | 12/1980 | Boulanger et al. | 200/5 A |
| 4,560,845 | 12/1985 | Takamura et al. | 200/5 A |
| 4,571,466 | 2/1986 | Iida | 200/5 A |
| 4,760,217 | 7/1988 | Suzuki et al. | 235/145 R X |

*Primary Examiner*—J. R. Scott

*Attorney, Agent, or Firm*—Wells, St. John & Roberts

[57] ABSTRACT

A dome sheet molded integrally from elastomeric rubber or plastic material is divided into two or more planar sheet sections, each containing a plurality of raised domes used in keyboard actuation. The adjacent sections are integrally joined by a hinged web having walls extending outward from the plane of the sheet. The web permits translational and angular movement of the adjacent sheet sections as required to properly position them between mating keyboard parts during keyboard assembly. This assures more accurate alignment between keyswitch actuators and keyboard switching elements associated with the individual domes about the dome sheet.

9 Claims, 2 Drawing Sheets

EXPANSION JOINT FOR KEYBOARD DOME SHEETS

TECHNICAL FIELD

This invention relates to electronic keyboards and particularly to an improvement in molded dome sheets interposed between aligned keyswitch actuators and switching elements in a keyboard.

BACKGROUND OF THE INVENTION

Dome sheets are widely used in the manufacture of electronic keyboards for many applications, including computer keyboards. As computer keyboards have become larger, due to inclusion of auxiliary keyswitches and pads, the underlying dome sheets used as keyswitch springs and/or switch element actuators have also progressed in size. The larger areas of such dome sheets pose a challenge in their manufacture, which involves molding elastomeric rubber or plastic material. The nature of the elastomeric materials and molding procedures used in manufacturing dome sheets has sometimes resulted in the production of dome sheets having less precision than their mating plastic parts in a keyboard assembly. The resulting variations in size create assembly difficulties as the dome sheets are mated to adjacent parts that must be aligned with the domes contained on them.

When individual domes on a sheet are misaligned with their mating keyswitch actuators or underlying switching elements in a keyboard, the result ies a degraded feel or touch. Because of this, some keyboard manufacturers currently design dome sheets in two or more separate parts so that the individual parts can be properly aligned with the keyswitch assemblies during assembly of a keyboard. This results in extra handling during keyboard assembly and increases the part count and cost for each keyboard.

Another approach that has been attempted to assure proper alignment of molded dome sheets involves inclusion of thin sections across the sheets to divide them into two separably positionable sections by a membrane lying within the plane of the sheet itself. When pulled, such a membrane tends to stretch the adjacent portions of the attached sheet sections. When pushed, it tends to buckle the adjacent edges of the attached sheet sections. Such thin sections within the plane of the sheet are also difficult to properly mold and have been found to have a tendency to tear during assembly.

Illustrative examples of dome sheets can be found in U.S. Pats. Nos. 4,560,845 and 4,571,466, each of which is hereby incorporated into this disclosure by reference. The design and manufacture of dome sheets is well-known, and further details concerning their general features are not believed necessary to an understanding of the present invention.

The present disclosure pertains to an expansion joint that effectively divides a dome sheet into two or more sections. This permits the manufacture of keyboards to accomodate normal molding tolerances encountered during the production of such sheets, particularly at the larger sizes required by modern computer keyboards. It eliminates distortion of the domed sheet itself during keyboard assembly and reduces tolerance accumulation, typically a percentage of the length of the part, to an acceptable level.

BRIEF DESCRIPTION OF THE DRAWINGS

The preferred emodiments of the invention are illustrated in the accompanying drawings, in which.

DETAILED DESCRIPTION OF THE PREFERRED EMBODIMENT

The following disclosure of the invention is submitted in compliance with constitutional purpose of the Patent Laws "to promote the progress of science and useful arts" (Article 1, Section 8).

The illustrated dome sheet is adapted to be positioned between aligned keyswitch actuators and switching elements (not shown) in a keyboard. It is applicable to any keyboard assembly, but has been designed specifically in reference to "enhanced" personal computer keyboards, which include a full alphanumeric keyboard layout, plus additional function keys, cursor keys and a ten key pad to the one side of the main keyboard layout.

Figure 1:
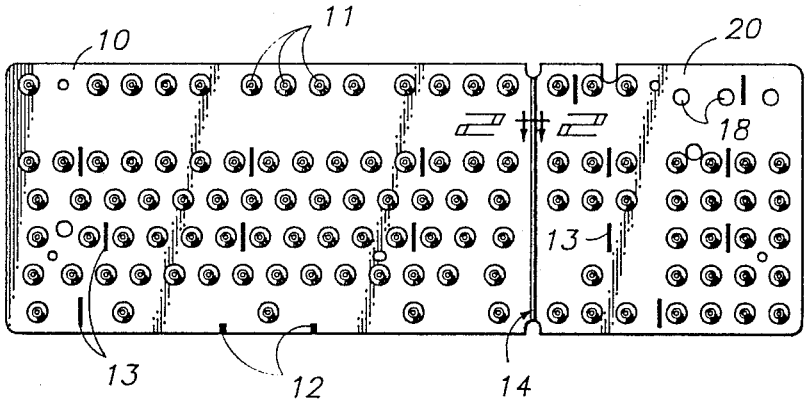
FIG. 1 is a plan view of the improved dome sheet.

FIG. 1 shows a plan view of a dome sheet designed for use in conjunction with an enhanced personal computer keyboard. It includes two principal sections labelled as 10 and 20. Section 10 would be associated with keyswitch actuators and switching elements for controlling the main alphanumeric functions of the keyboard. Section 20 would be associated with keyswitch actuators and switching elements used in conjunction with additional keyboard funtions, cursor control and a ten key pad. The details of such keyboards, keyswitch acutators and switching elements, which are well-known in keyboard construction, are not required for an understanding of the present invention.

The dome sheet includes a plurality of elastomeric raised domes 11 positioned about it to individually correspond with the positions of the switching elements of a computer keyboard with which the dome sheet is to be used. The raised domes are molded integrally with the sheet sections 10 and 20.

The dome sheet is typically positioned between mating parts of a keyboard assembly which support the aligned keyswitch acutators and switch elements. These parts are normally molded or fabricated from relatively rigid materials, and are designed to maintain high dimensional tolerances for proper alignment of the moving keyswitch elements and associated switching devices. However, because the dome sheet must be molded of elastomeric material, and because the molding of a dome sheet requires that substantial areas or domes be offset from the plane of the elastomeric sheet, it is difficult, if not impossible, to maintain similar tolerances during production of this elastomeric member. The dome sheet shown in FIG. 1 includes protruding yieldable domes 11 that can act as springs and/or switching actuators in conjunction with manually depressible keyswitch actuators that engage the center of each dome and depress it toward an underlying computer switching element, which can be a switch, capacitor, etc. The dome sheet also might include additional projections 12, various apertures 18 and alignment apertures shown as elongated slots 13. The alignment slots 13 position the dome sheet sections 10 and 20 between the aligned keyswitch actuators and switching elements with which they are to be used in an assembled keyboard. They receive corresponding projections (not shown) in adjacent mating keyboard parts.

Figure 2:
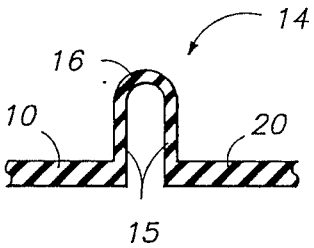
FIG. 2 is an enlarged sectional view taken along line 2—2 in FIG. 1.
Figure 3:
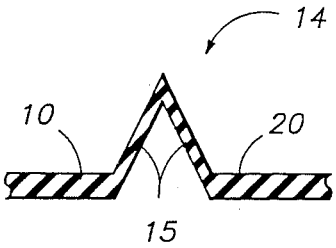
FIG. 3 is a view similar to FIG. 2, showing a modified expansion joint.
Figure 4:
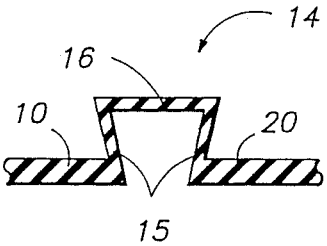
FIG. 4 is a view similar to FIG. 2, showing a modified expansion joint.
Figure 5:
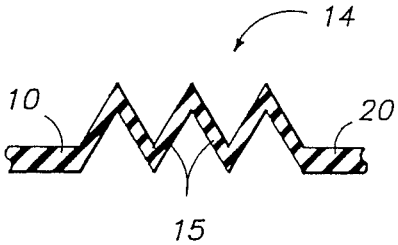
FIG. 5 is a view similar to FIG. 2, showing a modified expansion joint.
Figure 6:
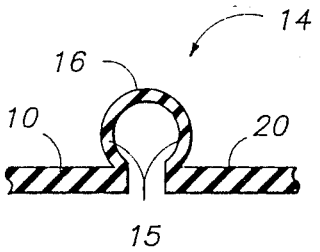
FIG. 6 is a view similar to FIG. 2, showing a modified expansion joint.

The novel aspect of this disclosure is an elongated web 14 that separates the two sections 10 and 20. As can be seen in FIG. 2, a cross-section of the web includes adjacent wall portions 15 that extend outward from the plane of the sheet. They are joined by a transverse wall 16 to complete an elastomeric web 14 molded integrally with the sheet sections 10 and 20.

The web 14 is adaptable to any molding process currently used for producing dome sheets. When molding dome sheets from liquid silicones, a center process is used and all material in the dome sheet must flow through the mold cavity. In this instance, the web 14 would be designed to have the same thickness as the remainder of the dome sheet, so as not to introduce any restriction to the flow of material through the mold. Dome sheets molded from rubber are produced by deforming a planar sheet and trimming off the excess material from the molded sheet edges. In this instance the web 14 can have a thickness less than the remainder of the dome sheet, since material flow through the web is not required.

Figure 7:
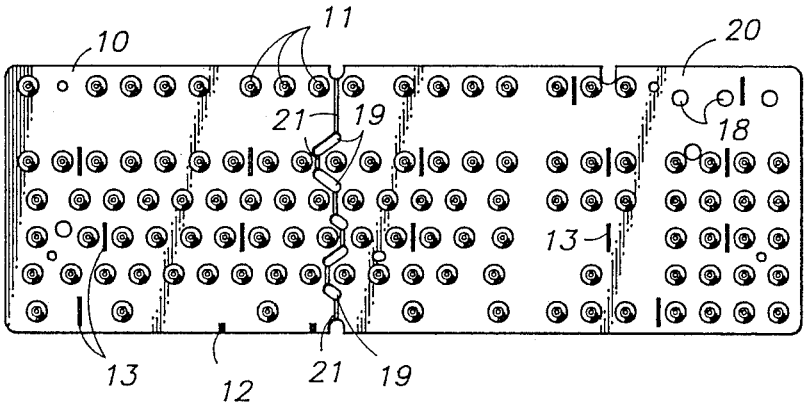
FIG. 7 is a plan view of a dome sheet showing a modification of the expansion joint layout.

The web 14 is preferably continuous across the width of the sheet sections 10 and 20, as shown in FIG. 1. However, when necessary, the web can be staggered across two or more sections of the dome sheet to fit intermittent webs 21 between the protruding domes 11. This is shown in FIG. 7, where the web elements 21 are spaced apart by enlarged openings 19 cut through the web and dome sheet. Also, while the web 14 is shown in a position extending across the width of the dome sheet, it is to be understood that a similar web can also be provided longitudinally across the full width of the dome sheet, if required for proper assembly of the keyboard components. Any number of webs can be formed across the dome sheet in any desired orientation to accomodate assembly requirements. The number of independently positionable sheet sections in a dome sheet is not limited to two, and can be two or more, depending upon the design of the keyboard.

While FIGS. 1 and 2 show web 14 in a U-shaped configuration extending outwardly from the plane of the dome sheet, FIGS. 3–6 show alternate outwardly-protruding webs that can be subsituted in place of this preferred cross-sectional configuration. In general, all of these cross-sectional configurations, and other equivalent configurations that might be designed on the same principle, include adjacent wall portions extending outward from the plane of the sheet to permit limited translational and angular movement of adjacent sheet sections relative to one another within the plane of the sheet during keyboard assembly without distorting the sheet sections.

In compliance with the statue, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A dome sheet adapted to be positioned between aligned keyswitch acutators and switching elements in a keyboard, comprising;

a planar sheet of elastomeric material;

a plurality of elasotmeric raised positioned about the sheet to individually correspond with the positions of the switching elements of a computer keyboard with which the dome sheet is to be used; and an elongated web dividing the sheet into at least two sections, the web having adjacent wall portions extending outward from the plane of the sheet to permit limited translational and angular movement of adjacent sheet sections relative to one another within the plane of the sheet during keyboard assembly without distorting the sections.

2. The dome sheet of claim 1, further comprising:

alignment means on both sheet sections for properly positioning the sections independently of one another between the keyswitch actuators and switching elements with which they are to be used in a keyboard.

3. The dome sheet of claim 1, further comprising:

a plurality of apertures formed through both sheet sections, the apertures being adapted to receive corresponding projections in adjacent mating keyboard parts for properly locating the sections within an assembled keyboard.

4. The dome sheet of claim 1, wherein the web extends continuously across the sheet.

5. The dome sheet of claim 1, wherein the adjacent wall portions of the web extend substantially perpendicular to the plane of the sheet.

6. The dome sheet of claim 1, wherein the adjacent wall portions of the web extend substantially perpendicular to the plane of the sheet and are integrally joined by a transverse wall that normally spaces the two sheet sections apart from one another.

7. The dome sheet of claim 1, wherein the thickness of the web is less than the thickness of the sheet.

8. The dome sheet of claim 1, wherein the web is interrupted by at least one opening formed through the web and sheet.

9. A dome sheet adapted to be positioned between aligned keyswitch actuators and switching elements in a computer keyboard assembly, comprising;

a planar sheet of molded elastomeric material;

a plurality of integral raised domes molded integrally with the sheet and individually positioned about the sheet to correspond with the positions of the swiching elements of a computer keyboard with which the dome sheet is to be used; and an elongated web molted integrally with the sheet and dividing the sheet into at least two sections, the web having adjacent wall portions extending outward from the plane of the sheet to permit limited translational and angular movement of adjacent sheet sections relative to one another within the plane of the sheet during keyboard assembly without distorting the sections.

* * * * *